US012378618B2

(12) United States Patent
Labrador Rodriguez

(10) Patent No.: US 12,378,618 B2
(45) Date of Patent: Aug. 5, 2025

(54) ADDITIVE FOR TREATING MOLTEN IRON TO PRODUCE CAST IRON WITH ZERO CONTRACTION AND WITH LONSDALEITE-TYPE SPHEROIDAL GRAPHITE

(71) Applicants: Francisco Alfonso Labrador Rodriguez, Coahuila (MX); Raymundo Eduardo Stackpole Armendariz

(72) Inventor: Francisco Alfonso Labrador Rodriguez, Saltillo (MX)

( * ) Notice: Subject to any disclaimer, the term of this patent is extended or adjusted under 35 U.S.C. 154(b) by 509 days.

(21) Appl. No.: 17/620,660

(22) PCT Filed: Jun. 17, 2020

(86) PCT No.: PCT/IB2020/055672
§ 371 (c)(1),
(2) Date: Dec. 17, 2021

(87) PCT Pub. No.: WO2020/254992
PCT Pub. Date: Dec. 24, 2020

(65) Prior Publication Data

US 2022/0243294 A1 Aug. 4, 2022

(30) Foreign Application Priority Data

Jun. 20, 2019 (MX) ..... MX/A/2019/007412

(51) Int. Cl.
*C21C 1/10* (2006.01)
*C22C 37/04* (2006.01)

(52) U.S. Cl.
CPC ..... *C21C 1/10* (2013.01); *C22C 37/04* (2013.01); *C21C 2250/00* (2013.01); *C21C 2300/08* (2013.01)

(58) Field of Classification Search
CPC ... C21C 1/10; C21C 2250/00; C21C 2300/08; C22C 37/04; B22D 1/00
(Continued)

(56) References Cited

U.S. PATENT DOCUMENTS 5,733,502 A 3/1998 Margaria et al.
2016/0138139 A1* 5/2016 Fujimoto ..... C22C 37/04 75/342

FOREIGN PATENT DOCUMENTS

CN 102615255 A * 8/2012
CN 105331763 A 2/2016
(Continued)

OTHER PUBLICATIONS

CN102615255A Translation (Year: 2012).*
(Continued)

*Primary Examiner* — Danielle M. Carda
(74) *Attorney, Agent, or Firm* — BCF LLP

(57) ABSTRACT

Additive for the thermochemical treatment of molten iron in order to separate, distribute, agglomerate, precipitate, spheroidize and/or crystallize combined, solvated and/or colloidal carbon present in molten iron in the liquid state into graphite in its hexagonal diamond or Lonsdaleite form, in order to produce ductile, nodular, spheroidal, vermicular, coral, spheroidized or grey iron with superior mechanical properties, iron with high metal yield and zero contraction during casting; the additive comprises two or more elements in the metallic state selected from the S-block of periods 2 to 7 of the periodic table of elements; and two or more elements in the metallic state selected from F-block of periods 6 to 7 of the periodic table of elements. The additive makes it possible to produce cast iron parts with Type I and II spheroidal graphite in hexagonal diamond or Lonsdaleite form as per the ASTM-A247 standard.

21 Claims, 5 Drawing Sheets

(58) Field of Classification Search
USPC ..... 75/314
See application file for complete search history.

(56) References Cited

FOREIGN PATENT DOCUMENTS

| | | | | | |
|---|---|---|---|---|---|
| CN | 107326139 | A | * | 11/2017 | ..... C21C 1/105 |
| CN | 108817327 | A | | 11/2018 | |
| WO | WO 2018/004356 | A1 | * | 1/2018 | ..... C21C 1/10 |

OTHER PUBLICATIONS

Qing et al., Growth Stages and Hexagonal-Rhombohedral Structural Arrangements in Spheroidal Graphite Observed in Ductile Iron, Carbon, 2017, 116, p. 456-469.

ASTM A247-19 Standard Test Method for Evaluating the Microstructure of Graphite in Iron Castings, ASTM International, Mar. 2019.

Koch et al., Inoculation of Grey and Ductile Iron, 7th International Ankiros Foundry Congress, Sep. 11-13, 2014, Istanbul.

International Search Report of PCT/IB2020/055672; Paula Schmidt Acharan; Aug. 19, 2020.

* cited by examiner

ADDITIVE FOR TREATING MOLTEN IRON TO PRODUCE CAST IRON WITH ZERO CONTRACTION AND WITH LONSDALEITE-TYPE SPHEROIDAL GRAPHITE

BACKGROUND OF THE INVENTION

The present invention refers to an additive to add to a mass of molten iron to produce cast iron with spheroidal graphite, a method for producing said additive, a method for producing cast iron with spheroidal graphite and items of cast iron with spheroidal graphite. More specifically, the present invention refers to an effective additive for producing cast iron with high metal yield and zero contraction during casting, due to its large count of spheroidal graphite in hexagonal diamond or Lonsdaleite form in accordance with Type I spheroid classification of standard ASTM-A247.

BACKGROUND OF THE INVENTION

Cast iron is typically produced in cupola or induction furnaces and generally contains from 2 to 4% by weight of carbon. Carbon is intimately mixed with iron and the shape of carbon in solidified cast iron is very important for the characteristics and properties of cast iron items. If carbon takes the form of iron carbide, then cast iron is referred to as white cast iron or white casting and it has the physical characteristics of being hard and brittle which in certain applications is undesirable. If carbon takes the form of graphite, cast iron has different ranges of mechanical and plasticity properties (such as machinability) and is classified as grey, malleable, compact, vermicular, ductile, nodular and/or spherical casting.

Graphite or free carbon may be present in cast iron in laminar, compact, coralline, vermicular, nodular and/or spheroidal form and in variations thereof. The spheroidal shape of graphite provides greater resistance and ductility to cast iron.

The shape, size, distribution, and numerical amount taken by graphite as well as the amount of graphite in relation to the amount of iron carbide may be controlled by certain additives that promote the formation of graphite before or during the solidification of molten iron. These additives are called spheroidizing agents, nodularizers, activators, grain refining agent or inoculants and their addiction to casting is done as an inoculation. In cast iron products, from liquid molten iron, there will always be formation of iron carbides. The formation of iron carbides in a cast iron product is prevented or reduced by the addition of additives to the liquid molten iron. These additives are nodularizers and/or spheroidizers and inoculants, activators and/or grain refiners.

Nowadays, the process of solidification of molten iron brings into play a series of transformations of great industrial interest, since the formation of graphite, its final morphology, and the structure of the metallic matrix at room temperature depends on them. All these characteristics define the mechanical properties and functionality of the material for use in parts with high requirements.

In the solidification stage, the formation of porosity, density, volume, and nodularity defects is common in the material associated with volumetric and metallic contraction and expansion (macro shrinkage cavity, shrinkage cavity, micro shrinkage cavity, as well as deformations in graphite nodules) that adversely affect the metallic yield of the casting and the mechanical properties of the cast iron parts obtained.

The formation of defects and porosity is particularly critical in the semi-solid state, where there are inadequacies in the supply of liquid material in the areas of last solidification. As the state change advances, the solidification front must be constantly fed with iron in liquid casting to prevent permanent cavities from forming in the solid state. However, as temperature decreases, viscosity of the iron in liquid cast iron increases, considerably decreasing the capacity of the iron to compensate for the contraction phenomenon; regarding nodularity, the latter deteriorates very quickly (maximum safety time of 8 minutes from moment of reaction) generating heterogeneous nodules in type, density, and size, generating contractionary and cyclically expandable liquids. Although these defects are now very common in the world of casting, their incidence remains one of the main problems of quality and metallic yield of iron casting today.

Defects occur because graphite nodules are formed by growth in the solidification phase of the iron, i.e., in the phase from contraction to expansion and vice versa of the material, defects that are favored because the size, shape, the structure and distribution of nodular graphite are not adequate, currently leading to metal efficiency in the casting industry within the range of 50%.

For these reasons, it is of great interest to produce ductile iron parts from the use of additives that promote, under thermodynamical principals, the formation of spheroidal graphites from the liquid phase of iron, by the precipitation of crystalline graphite (Lonsdaleite) nodules in a high carbon peritectic reaction zone, or inconsistent carbon fusion, so that nodulants and/or magnesium-based additives combined with metals from rare earth elements are now used, elements being basically cerium or lanthanum in their rare earth element state (RE), metal of rare earth element (REM), rare earth elements (REE), oxides from rare earth elements (REO) and combinations thereof; however the production spheroidal graphites in crystalline hexagonal diamond Type I (Lonsdaleite) is very low, presenting the parts produced with these additives preferentially amorphous nodules composed of powdered hexagonal graphite Types I, II, III, IV, V, according to the ASTM A-247 norm, generating considerable expansions and contractions that limit the metallic yield, as well as the formation of internal defects and structural nodular deficiencies, so in essence the formation of structurally amorphous nodules of graphites Type I, II, III, IV and V according to ASTM A-247 are generated until today in the solidification phase from or below the eutectic temperature of that metal.

Based on the above, there is a need to provide the molten iron bath with a spheroidizing additive that promotes an adequate pattern of formation and precipitation of spheroidal graphite during the casting process (in liquid phase), to ensure that such spheroidal graphites acquire a predominantly hexagonal diamond or Lonsdaleite shape, in accordance with ASTM-A247 Type I and/or II classification standard, to provide cast iron items with a superior spheroidal density and of adequate distribution of spheroidal graphite in hexagonal diamond or Lonsdaleite form, always within a solidification (crystallization of the liquid) anti-eutectic, that is, derived from eutectic, in order to prevent porosity and/or cavity defects, volumetric contractions and/or expansions by increasing the metallic yield of the cast iron, and improving the physical and mechanical characteristics and properties of the cast iron items that are produced.

SUMMARY OF THE INVENTION

Referring to the aforementioned and with the purpose of offering a solution to the encountered limitations, this invention is aimed at offering an additive for treating molten iron that allows the separation, diffusion, agglomeration, precipitation, spherodizing and/or crystallization of the combined carbon, solvated and/or colloidal present in liquid molten iron in the form of free carbon (graphite) predominantly as Lonsdaleite in ductile iron, this process generated by thermochemical treatment to produce ductile, nodular, spheroidal, vermicular, coral, spheroidized or grey iron with superior mechanical properties higher than class 50. The additive comprises two or more elements in metallic state selected from S-block of periods 2 to 7 of the periodic table of elements, and two or more elements in metallic state selected from F-block of periods 6 to 7 of the periodic table of elements.

It is also the aim of the present invention to offer a method for producing an additive for treating molten iron containing carbon to produce cast iron with spheroidal graphite in hexagonal diamond or Lonsdaleite form, the method includes the steps of (a) providing two or more elements in metallic state selected from S-block of periods 2 to 7 of the periodic table of elements and two or more elements in metallic state selected from F-block of periods 6 to 7 of the periodic table of elements; and (b) casting, mixing, and/or joining the two or more elements in metallic state selected from S-block of periods 2 to 7 with the two or more elements in metallic state selected from F-block of periods 6 to 7 of the periodic table of elements.

It is also the aim of the present invention to offer the use of an additive of the present invention in a casting process for treating molten iron containing carbon to produce cast iron with spheroidal graphite in hexagonal diamond or Lonsdaleite form.

Another purpose of the present invention is to offer a method for producing cast iron items with spheroidal graphite in hexagonal diamond or Lonsdaleite form, the method includes the steps of: (a) preparing a molten iron with carbon from a determined metallic load; (b) reacting the molten iron with an additive as a spheroidizing agent comprising two or more elements in metallic state selected from S-block of periods 2 to 7 of the periodic table of elements, and two or more elements in metallic state selected from F-block of periods 6 to 7 of the periodic table of elements; (c) allowing the formation and precipitation of spheroidal graphites in the molten iron in liquid phase by a thermochemical reaction; (d) inoculating the molten iron with an additive as an activator agent or grain refiner to nodulate the remaining graphite from the remaining carbon and retaining only the required combined carbon within the structural phases in the molten iron, wherein the activator agent or grain refiner comprises two or more elements in metallic state selected from S-block of periods 2 to 7 of the periodic table of elements, and two or more elements in metallic state selected from F-block of periods 6 to 7 of the periodic table of elements; and (e) pouring the molten iron into a mold. The production of any type of cast iron part with this method provides metallic yields equal to or higher than 75% (75% minimum of Height Yield in English), based on low linear, volumetric and/or metallic contraction, which is generated using the additive of this invention, a technical principle called "zero contraction".

Finally, another aim of the invention is to offer a cast iron item prepared in accordance with the method for producing cast iron items with spheroidal graphite of the present invention, the cast iron item includes lanthanide contraction elements and scandide contraction elements in stoichiometric proportion according to the percentage of additive as a spheroidizing agent and the additive as an activator agent used during the preparation of the cast iron item; at least 80% of the presence of spheroidal graphite in hexagonal diamond or Lonsdaleite form in accordance with the ASTM-A247 standard Type I and II spheroid classification; a minimum graphite spheroid density of 300 spheroids/mm$^2$; and a spheroidal graphite size smaller than number 4.

BRIEF DESCRIPTION OF THE FIGURES

Other characteristics of this invention will be evident from the following detailed description considered in connection with the attached drawings. It should be understood, however, that the drawings are only made as an illustration and not as a limiting definition of the invention, in which.

DETAILED DESCRIPTION OF THE INVENTION

Figure 1:
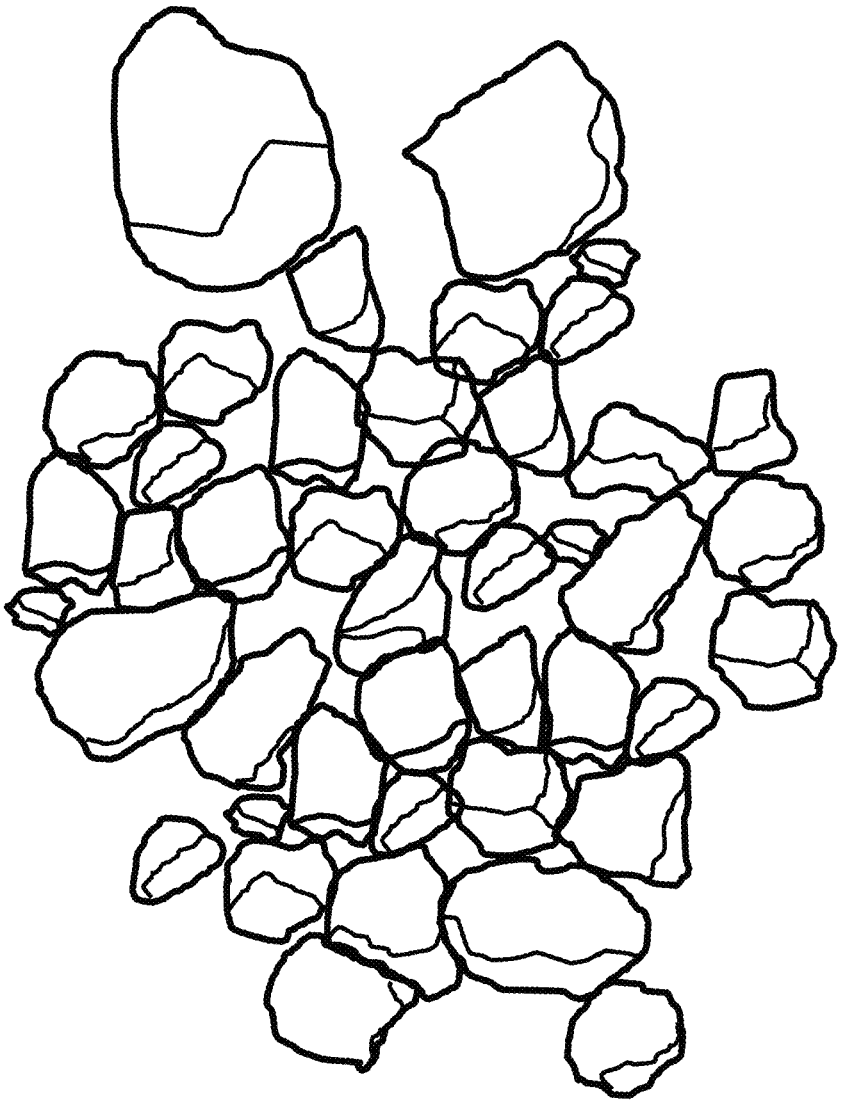
FIG. 1 shows a photograph of a presentation of the additive for treating molten iron of the present invention.

The characteristic details of the invention are described in the following paragraphs, which are for the purpose of defining the invention but without limiting the scope of the invention.

Within the context of the present invention, the term "element in metallic state" means an element which constitutes a metal (in the additive for treating molten iron of the present invention) where the "metal" may well be alkaline, alkaline-earth, transitional or internal transition, reduced with a purity of at least 85% of each particular element; the term "element in metallic state" corresponds to a pure metal and does not include any compound that has an ionic bond or covalent bond, such as an oxide, fluoride, sulfide, carbonate or nitride thereof. The element in metallic state is incorporated or not in an alloy or an intermetallic, mineral, or synthetic compound that includes its mother phase or solvent.

In the context of the present invention, the term "zero contraction" means counteracting the graphite expansion generated by the change in density (Gr/cc) between the combined carbon and/or iron carbide against the formation of graphite (hexagonal) or free carbon within iron. It also applies to counteracting the volumetric contractions and/or expansions produced by iron in the phase changes of matter in the process of fusion transformation and/or solidification.

In this description, the term "cast iron" means ductile iron, nodular iron, spheroidal iron, vermicular iron, coral iron, globulized iron, or grey iron of high mechanical properties.

In this description, the term "ductile iron" means the tendency and/or presence of an elongation property in a molten iron at room temperature.

The composition of the additive for treating molten iron that contain carbon to produce cast iron with spheroidal graphite according to the invention shows compounds which in turn could consist of multiple components.

The compounds are individually described below, without necessarily being described in order of importance.

Elements from S-Block of the Periodic Table

The additive for treating molten iron containing carbon to produce cast iron with spheroidal graphite in hexagonal diamond or Lonsdaleite form, of the present invention, contains two or more elements in metallic state selected from S-block of periods 2 to 7 of the periodic table of elements, particularly selected from group IA, such as lithium, sodium, potassium, and rubidium, and from group HA, such as beryllium, magnesium, calcium, and barium.

These two or more elements in metallic state are in an amount of 2 to 15% by weight of the total additive.

Elements from F-Block of the Periodic Table

The additive for treating molten iron containing carbon to produce cast iron with spheroidal graphite in hexagonal diamond or Lonsdaleite form, of the present invention, contains two or more elements in metallic state selected from F-block of periods 6 to 7 of the periodic table of elements. Within F-block, period 6, the elements in metallic state are selected from lanthanum, cerium, praseodymium, and neodymium; and within F-block, period 7, the elements in metallic state are selected from actinium, thorium, and protactinium.

These two or more elements in metallic state are in an amount of 1 to 15% by weight of the total additive, provided that at least four elements are together in the additive, the two in S-block and the two in F-block:

a. The same results are obtained when the two elements of F-Block (always be at least two) are found each element at the percentage of 1% at minimum weight.
b. This has a mandatory condition and is provided that the other two elements of the additive (minimum two elements corresponding to S-block) are kept at the same 2% by minimum weight concentration of each element in the additive.

The present invention is the first practice that contemplates the joint use of two elements of F-Block (working together) in this type of application.

Elements from P-Block P of the Periodic Table

The additive for treating molten iron containing carbon to produce cast iron with spheroidal graphite in hexagonal diamond or Lonsdaleite form, of the present invention, additionally comprises elements selected from P-block of the periodic table of elements, particularly selected from group IV A, such as carbon and silicon, and from group VI A, such as oxygen and sulfur.

The elements from P-block of group IV A and/or group VI A can be found in an amount of 7 to 70% by weight of the total additive.

Base, Vehicle or Solvent of the Additive

The additive for treating molten iron containing carbon to produce cast iron with spheroidal graphite in hexagonal diamond or Lonsdaleite form, of the present invention, may be used in metallurgy, in the production and manufacture of ductile iron, nodular iron, spheroidal iron, vermicular iron, coral iron, globulized iron, and in the production and manufacture of grey iron of high mechanical properties (from Class 50 Grey Iron) which are found in the following bases:

(A) Metal or metalloid base:

Bases or solvent consisting of metals and/or metalloids, such as: ferro-manganese, ferro-silicon, which are alloyed with the elements in metallic state of S-block and F-block of the periodic table of elements indicated above, base that as solvent contains them as solutes, either in a solid-in-solid or solid-in-soluble relationship.

Base or solvent of metal alloys and/or metalloids, which work as a vehicle for the elements in metallic state of S-block and F-block of the periodic table of elements indicated above, this base may contain as a metal base and/or metalloid, any percentage level of a metalloid or metal with the corresponding levels of metallic and non-metallic contaminants associated with mineralogical genetics (genetics of the mineral area used in the manufacture of the base or solvent) as well as impurities resulting from all other mineral components used in the manufacture of the base or solvent, such as fluxes, reducers and other inherent in the production process of such metal or metalloid bases.

Metal and/or metalloid base which as a solvent may contain in solid mixture in phase solution or form of metal and/or non-metal, any percentage level in mass (weight) of impurities and/or alloys of elements such as aluminum, sulfur, barium, beryllium, calcium, carbon, fluorine, iron, lithium, magnesium, manganese, potassium, rubidium, silicon, sodium; and the possible presence of traces, such as metal sulphides, oxygen, metal oxides, lanthanide oxides, lanthanide fluorides, lanthanide sulphides and/or rare earth belonging to the production process of said metal and/or metalloid base.

(b) Non-metallic base

Base or solvent consisting of elements (metals and/or non-metals) in phase or non-metallic form, such as: concrete, pressed bricks of minerals, plastics, synthetic pastes, which serve as substrate or sustenance or solvent, where they have been added and/or agglomerated, containing the elements in metallic state of S-block and F-block of the periodic table of the elements indicated above within that non-metallic base, in phase or solid mixture.

Non-metallic base, which as a solvent may contain in mixture, in phase of metal and/or non-metal, any percentage level in mass (weight) of impurities and/or aggregates of elements such as aluminum, sulfur, barium, beryllium, calcium, carbon, fluorine, iron, lithium, magnesium, manganese, potassium, rubidium, silicon, sodium; and the possible presence of traces such as metal sulphides, oxygen, metal oxides, lanthanide oxides, lanthanide sulphides and/or rare earth from the production process of this non-metallic base.

Preparation Mode of the Additive of the Invention

The additive for treating molten iron containing carbon to produce cast iron with spheroidal graphite in hexagonal diamond or Lonsdaleite form, of the present invention, may be elaborated either by one, several or by the partial union of the following industrial processes:

1. By metal reduction, either direct, primary and/or secondary reduction, where the elements in metallic state selected from the S-block and F-block of the periodic table can be reduced and/or metalized together and/or separately.
2. By fusion and/or secondary fission, where the elements in metallic state selected from the S-block and F-block of the periodic table can be reduced and/or metalized together and/or separately.
3. By joint and/or separate alloy adjustment, either in the direct reduction phase, primary reduction phase and/or metal secondary reduction phase; or at the later stage of fusion and/or secondary metal fission, where the elements in metallic state selected from the S-block and F-block of the periodic table can be reduced, mixed and/or metalized together and/or separately.
4. By mechanical mixing of the elements in metallic state selected from the S-block and F-block of the periodic table together or separately, which can be previously reduced, metalized and/or fused according to the industrial processes 1, 2 and 3 above indicated.
5. By solvation of alloys and/or by aggregates of metallic and/or non-metallic compounds containing the elements in metallic state selected from the S-block and F-block of the periodic table, and obtained according to the industrial processes 1, 2 and 3 above indicated.
6. By mechanical mixing of the different metallic compounds with non-metallic, containing the elements in metallic state selected from the S-block and F-block of the periodic table, and obtained according to the industrial processes 1, 2 and 3 above indicated.
7. By metallic and non-metallic aggregates, in the form of blocks, masses, pastes, wires, wires, encapsulated or aggregates containing the elements in metallic state selected from the S-block and F-block of the periodic table that have been obtained according to the industrial processes 1, 2 and 3 above indicated.

The additive of the present invention, for presentation as a product on the market, may be incorporated in metallic powders or granulates (as illustrated in FIG. 1), in non-metallic powders or granulates, in metallic and non-metallic powders and/or granulates encapsulated or encased in other metal or other material, in metallic and/or non-metallic granulates, in metallic and/or non-metallic aggregates, in solid metal or non-metallic alloys in any granulometry, in metal and/or non-metal pastes, in synthetic compounds in any presentation and combinations thereof.

Application Mode of the Additive in Casting

The additive in this invention may be used in the production and manufacture of ductile iron, nodular iron, spheroidal iron, vermicular iron, coral iron, globulized iron or grey iron of high mechanical properties. The additive in this invention acts as:

a) A spheroidizing agent (graphite) of the free carbon, by thermodynamic manipulation of liquid iron, generating a spheroid in the specific form of hexagonal diamond or Lonsdaleite, which has been classified as a Type I and II spheroid according to ASTM-A247 in ductile iron foundries also known as nodular iron.
b) A coralinoids retaining agent of the free carbon in its allotropic form of amorphous, semi-crystalline and/or crystalline hexagonal graphite, through the joint segregation of graphitic clusters, graphitic spouts and/or graphitic sleeves that thermodynamically form graphitic cyclones. These graphite agglomerations are grouped into either hexagonal graphite vermules, hexagonal graphite stony coralines, hexagonal graphite amorphous suction cups, hexagon diamond graphite Lonsdaleites and/or the jointly mix presenting Types I, II, III, IV, V and VII in accordance with ASTM-A247 as forms of free carbon agglomeration present as hexagonal graphite within the produced iron.
c) An inhibiting agent and moderator of the longitudinal growth of the hexagonal graphite sheet and as increaser of the hexagonal graphite sheet in its axial plane (laminar graphite) Type VII in accordance with ASTM-A247 in grey iron castings of high mechanical properties with distribution Type A, B and C.
d) A genetic activator agent, such as free energy contributors to the metal bath, such as isothermal holders, as ionic passivators, such as co-moderators and/or as austenitic grain refiners; it comes to control the segregation, sustainability, and diffusion of the combined carbon within the crystalline structural phases (matrix) that will be present in the solidified iron castings.

Based on the above, the present invention is also a method for the production of cast iron under the practice of high metallic yield to produce items that require a high profitability achieved through high metallic yield and high mold yield, therefore a large amount of spheroidal graphite in the form of hexagonal diamond or Lonsdaleite is desired to crystallize in accordance with the ASTM-A247 Type I and II spheroid classification standard in the liquid phase of molten iron, the molten iron must therefore be made to react and inoculate the additive of the present invention as a spheroidizing agent and/or activator agent or grain refiner, respectively. It is therefore that the method for producing cast iron items of zero contraction and with spheroidal graphite, contemplates the steps of: (a) preparing a molten iron with carbon from a determined metallic load; (b) reacting the molten iron with an additive as a spheroidizing agent of the present invention; (c) allowing the formation and precipitation of spheroidal graphites in the molten iron in liquid phase by a thermochemical reaction; (d) inoculating the molten iron with an additive as an activator agent or grain refiner of the present invention to nodulate the remaining graphite from the remaining carbon and retaining only the required combined carbon within the structural phases in the molten iron; and pouring the molten iron into a mold with a minimum ratio of 750 kg of items per metric ton of treated and poured iron casting.

The additive as a spheroidizing agent and the additive as an activator agent or grain refiner of this invention comprise two or more elements in metallic state selected from S-block of periods 2 to 7 of the periodic table of elements, and two or more elements in metallic state selected from F-block of periods 6 to 7 of the periodic table of elements.

The molten iron with carbon is prepared in any iron melting equipment, with a minimum temperature of 1,350° C. and a maximum recommended temperature of 1,500° C., with metallic iron, steel scrap and/or cast iron, adjusting the chemical composition to the recommended normal carbon values, silicon, and alloying elements such as manganese, chromium, among others, which are required according to the recommended grade for such molten iron alloy. This metallic bath is subsequently spheroidized and inoculated with the additives of the present invention.

The additive as a spheroidizing agent can be of multiple bases such as ferro-silicon, ferro-manganese, metal briquettes, reduced and/or non-metallic, concrete, ceramic, metal masses, wires, metallic wires filled, encapsulated, plastic, etc. and are added or incorporated into the molten iron by any method of inoculation always inside the liquid metal to be spheroidized and/or activated.

The additive as an activator agent or grain refiner can be of multiple bases such as ferro-silicon, ferro-manganese, metal, reduced and/or non-metallic briquettes, concrete, ceramic, metal masses, wires, filled wires, encapsulated, plastic, among others are added or incorporated into the molten iron by any method of inoculation that ensures that it will always come into contact and within the liquid metal to be inoculated and/or activated.

The additive as a spheroidizing agent is added in an amount from 0.40 to 1.50% by weight on the liquid metal to be treated or spheroidized; while the additive as an activator or grain refiner is added in an amount from 0.10 to 1.0% by weight or in proportion to the liquid metal of iron to be inoculated.

Metallic Yield and Produced Cast Iron Items

The cast iron items obtained in accordance with the method for producing cast iron items with zero contraction and with spheroidal graphite in hexagonal diamond or Lonsdaleite form of the present invention, they show a microstructure with spheroidal graphites of hexagonal diamond or Lonsdaleite in the minimum range of 300 spheroids/mm$^2$, the size of the graphites being less than 4 and a distribution of the Type I and II graphites at a minimum of 80%. These density, size and distribution parameters have been measured in accordance with the ASTM A-247 standard.

In addition, cast iron items obtained in accordance with the method for producing cast iron items with zero contraction and with spheroidal graphite in hexagonal diamond or Lonsdaleite form of the present invention, they present in their chemical composition lanthanide contraction elements and scandide contraction elements that originate from the reactions of the elements in metallic state selected from F-block from the period 6 to 7 of the periodic table of elements contained in the additives of the present invention used in the method of the present invention with which they were elaborated. The contents of these lanthanide contraction elements and scandide contraction elements are due to the stoichiometric ratio in weight of the additive used.

The fact that during the method for producing cast iron items with zero contraction and with spheroidal graphite in hexagonal diamond or Lonsdaleite form of the present invention, the spheroidal graphites of hexagonal diamond or Lonsdaleite are formed and precipitated in accordance with the ASTM-A247 standard Type I and II spheroid classification, allows high metallic yield between 55 and 95%, preferably between 75 and 95%, compared with traditional casting methods that in all existing industrial processes ranging from 45 to 55% typical average metal yield, with operating productivities between 41 and 50% typical averages. These high metallic yields are achieved by the technical effect of zero contraction caused by the high concentration of formed spheroidal graphite in hexagonal diamond or Lonsdaleite form, giving rise to the compensation of the graphitic expansion and the metallic contraction by the effect of a stable operating density defined as "metallurgical quality" and by a lower viscosity of the liquid when it is poured.

Examples of Conducting the Invention

The invention will now be described according to the following examples, which have the unique purpose of representing how to implement the principles of the invention. The following examples do not attempt to be an exhaustive representation of the invention, nor do they attempt to limit the scope of the invention.

Preparation of Examples of Additives of the Invention

Twelve additives which act as spheroidizing agents of chemical compositions of examples 1 to 12 were prepared in accordance with the present invention and whose composition in percentage % weight is shown in Table 1.

TABLE 1

| | Elements in metallic state | | | | | | | Non-Metallic Elements | | |
|---|---|---|---|---|---|---|---|---|---|---|
| | Elements in S-block of the periodic table | | | | Elements in F-block of the periodic table | | | Elements in P-block of the periodic table | | |
| Example | Na | Li | K | Rb | Ac | Ce | Nd | C | Si | O |
| 1 | 5.56 | 4.03 | 3.53 | 0.08 | 8.12 | 7.15 | — | 39.43 | — | — |
| 2 | 5.28 | 4.01 | 3.6 | 0.11 | 8.23 | 7.32 | — | 38.65 | — | 1.08 |
| 3 | 5.61 | 4.23 | 3.52 | 0.09 | 8.02 | 7.01 | — | 38.92 | — | — |
| 4 | 5.42 | 3.97 | 3.47 | 0.09 | 8.21 | 7.33 | — | 37.45 | — | 1.12 |
| 5 | 9.45 | 3.12 | 3.98 | — | 8.22 | 7.42 | — | — | 25.45 | — |
| 6 | 8.38 | 3.24 | 3.87 | — | 8.06 | 7.18 | — | — | 26.05 | 2.12 |
| 7 | 7.26 | 3.09 | 3.93 | — | 8.13 | 7.03 | — | — | 26.00 | — |
| 8 | 6.46 | 3.22 | 4.00 | — | 8.09 | 7.26 | — | — | 25.82 | 2.09 |
| 9 | 3.52 | 8.97 | 4.54 | 0.44 | 6.21 | 9.45 | 0.33 | 20.11 | 13.03 | — |
| 10 | 3.49 | 9.15 | 4.48 | 0.39 | 5.99 | 9.54 | 0.31 | 21.08 | 12.67 | 2.03 |
| 11 | 3.51 | 9.23 | 4.65 | 0.41 | 6.03 | 9.32 | 0.37 | 39.34 | 7.12 | — |
| 12 | 3.49 | 9.07 | 4.72 | 0.42 | 6.32 | 9.61 | 0.53 | 38.06 | 7.34 | — |

In addition, twelve other additives that act as spheroidizing agents of chemical compositions of examples 13 to 24 were prepared in accordance with the present invention and whose composition in percentage % weight is shown in Table 2.

TABLE 2

| | Elements in metallic state | | | | | | | Non-Metallic Elements | | |
|---|---|---|---|---|---|---|---|---|---|---|
| | Elements in S-block of the periodic table | | | | Elements in F-block of the periodic table | | | Elements in S-block of the periodic table | | |
| Example | Ba | Be | Ca | Mg | La | Ce | Pr | Si | C | S |
| 13 | 10.52 | 6.84 | 4.12 | 1.08 | 3.56 | 8.96 | — | 38.34 | — | — |
| 14 | 11.04 | 7.63 | 3.87 | 1.11 | 3.72 | 8.51 | — | — | 39.14 | 4.78 |
| 15 | 9.85 | 8.25 | 4.51 | 0.09 | 3.81 | 9.03 | — | 37.01 | 5.03 | — |
| 16 | 8.62 | 8.72 | 4.24 | 0.08 | 3.67 | 8.46 | — | 36.23 | — | 5.06 |
| 17 | 15.21 | 15.23 | 5.04 | 1.52 | 13.56 | 3.58 | — | 25.21 | 10.23 | 3.83 |
| 18 | 19.23 | 13.05 | 4.78 | 1.49 | 14.01 | 3.73 | — | 26.15 | 11.02 | — |
| 19 | 21.12 | 11.21 | 5.21 | 1.48 | 15.03 | 3.98 | — | 11.97 | 27.25 | 5.52 |
| 20 | 24.53 | 9.17 | 5.27 | 1.56 | 16.01 | 3.82 | — | 10.87 | 26.52 | — |
| 21 | 2.21 | 3.15 | 1.89 | 5.34 | 4.56 | 10.23 | 0.45 | 20.23 | 20.21 | 2.12 |
| 22 | 2.03 | 3.54 | 2.00 | 5.12 | 4.67 | 11.04 | 0.52 | — | 31.03 | 2.03 |
| 23 | 1.75 | 3.04 | 1.96 | 5.22 | 4.81 | 10.52 | 0.39 | 36.68 | 3.21 | 1.03 |
| 24 | 1.50 | 3.10 | 2.03 | 5.04 | 5.01 | 10.01 | 0.43 | 3.34 | 38.00 | 1.13 |

On the other hand, twelve additives that act as activators or grain refiners of chemical compositions of examples 25 to 36 were prepared in accordance with the present invention and whose composition in percentage % weight is shown in Table 3.

TABLE 3

| | Elements in metallic state | | | | | | | Non-Metallic Elements | | |
|---|---|---|---|---|---|---|---|---|---|---|
| | Elements in S-block of the periodic table | | | | Elements in F-block of the periodic table | | | Elements in S-block of the periodic table | | |
| Example | Na | Li | Rb | K | Ce | Ac | Nd | RExO | Si | C |
| 25 | 5.53 | 4.05 | — | 1.02 | — | — | 4.36 | 4.56 | 26.31 | — |
| 26 | 6.02 | 4.12 | — | 0.98 | — | — | 4.56 | 4.68 | 26.12 | 0.32 |
| 27 | 6.12 | 4.09 | — | 0.99 | — | — | 5.57 | 5.76 | — | 25.32 |
| 28 | 6.22 | 3.98 | — | 1.04 | — | — | 4.55 | 4.61 | 28.36 | — |
| 29 | 7.32 | 3.23 | 2.03 | 0.53 | 4.12 | 5.51 | — | — | — | 24.80 |
| 30 | 7.51 | 3.09 | 2.12 | 0.46 | 4.23 | 6.39 | — | — | 28.61 | 0.38 |
| 31 | 7.48 | 3.15 | — | 0.50 | 4.06 | 6.43 | — | — | — | 28.02 |
| 32 | 7.51 | 3.18 | 2.06 | 0.42 | 4.08 | 6.29 | — | — | 28.01 | — |
| 33 | 8.39 | 5.12 | 2.45 | — | 7.52 | — | — | 4.54 | — | 26.54 |
| 34 | 8.61 | 6.09 | 2.51 | — | 7.57 | — | — | 4.63 | 24.87 | 0.41 |
| 35 | 8.58 | 7.21 | 2.61 | — | 7.49 | — | — | 4.49 | 25.23 | 0.34 |
| 36 | 8.53 | 8.01 | 2.48 | — | 7.51 | — | — | 4.52 | — | 29.02 |

RExO: Oxygen exothermic reducer (e.g., aluminum powder + magnesium oxide)

In addition, twelve other additives that act as activators or grain refiners of chemical compositions of examples 37 to 48 were prepared in accordance with the present invention and of which the composition in percentage % weight is shown in Table 4.

TABLE 4

| | Elements in metallic state | | | | | | | Non-Metallic Elements | | |
|---|---|---|---|---|---|---|---|---|---|---|
| | Elements in S-block of the periodic table | | | | Elements in F-block of the periodic table | | | Elements in S-block of the periodic table | | |
| Example | Ba | Ca | Mg | Be | Ce | La | Pr | RExO | Si | C |
| 37 | 9.01 | 3.45 | 1.54 | 0.66 | 2.58 | — | — | 4.56 | 59.74 | 1.50 |
| 38 | 8.54 | 4.36 | 1.33 | 0.75 | 5.01 | — | — | 2.62 | 60.32 | — |
| 39 | 7.61 | 5.31 | 1.54 | 0.77 | 2.85 | — | — | 5.76 | — | 35.65 |
| 40 | 6.53 | 2.34 | 2.03 | 0.54 | 6.02 | — | — | 2.56 | 39.01 | — |
| 41 | 16.02 | 2.56 | — | 0.09 | — | 5.02 | 5.32 | — | — | 36.21 |
| 42 | 13.89 | 3.52 | — | 0.12 | — | 9.23 | 9.21 | — | 45.98 | 0.98 |
| 43 | 10.99 | 3.98 | — | 0.16 | — | 11.89 | 1.22 | — | — | 29.12 |
| 44 | 8.62 | 4.20 | — | 0.23 | — | 1.00 | 13.01 | — | 32.89 | — |
| 45 | 16.49 | 3.51 | 2.03 | — | 6.45 | — | 2.18 | — | — | 33.34 |
| 46 | 16.07 | 2.54 | 2.07 | — | 4.89 | — | 2.11 | — | 25.54 | 10.03 |

TABLE 4-continued

| | Elements in metallic state | | | | | | | Non-Metallic Elements | | |
|---|---|---|---|---|---|---|---|---|---|---|
| | Elements in S-block of the periodic table | | | | Elements in F-block of the periodic table | | | Elements in S-block of the periodic table | | |
| Example | Ba | Ca | Mg | Be | Ce | La | Pr | RExO | Si | C |
| 47 | 13.53 | 3.41 | 2.51 | — | 3.03 | — | 2.06 | — | 38.13 | 5.17 |
| 48 | 13.05 | 3.00 | 2.56 | — | 5.99 | — | 2.21 | — | — | 38.24 |

RExO: Oxygen exothermic reducer (e.g., aluminum powder + magnesium oxide)

Automotive Nodular Iron Preparation ASTM D-654512 Grade

Figure 2:
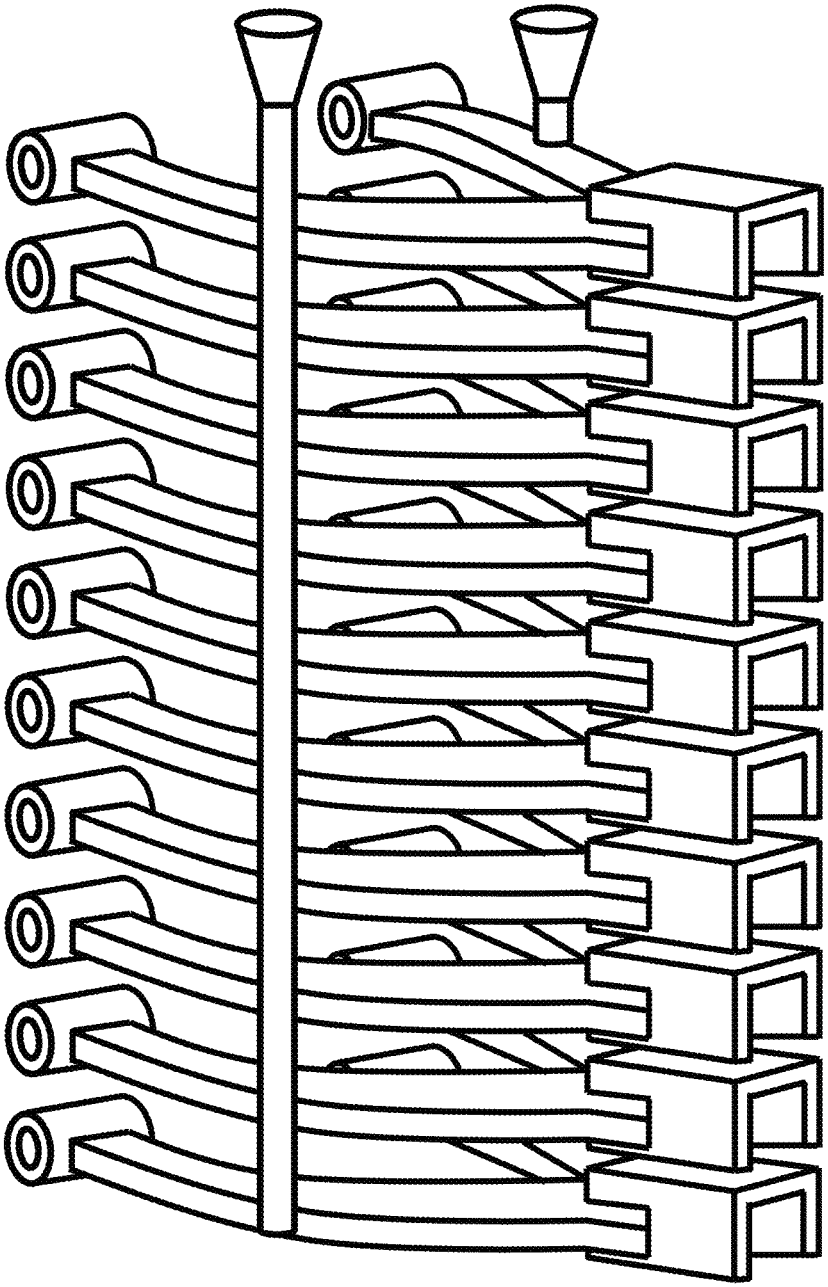
FIG. 2 shows a realization of a tree casting of control arms for car suspension molded in a sand mold obtained from the method for producing cast iron items with spheroidal graphite in hexagonal diamond or Lonsdaleite form of the present invention.

A molten iron with 3.70% by weight of carbon was prepared, from a metallic load of 1,500 kg consisting of 30% return cast iron and 70% steel sheet, at a fusion temperature of 1,480° C. The molten iron reacted at a temperature of 1,480° C. in a reaction pot containing the additive as a spheroidizing agent according to Example 10 of Table 1, in an amount of 10.5 kg, allowing the formation and precipitation of spheroidal graphites in the molten iron in liquid phase during 45 seconds of reaction; the additive was subsequently inoculated into molten iron as an activator or grain refiner agent according to Example 34 of Table 3 in an amount of 2.25 kg in granular form; then 180.5 kg of the molten iron was poured into a green sand mold to mold 10 control arms for car suspension (as illustrated in FIG. 2), each of the control arms for car suspension requiring 15.52 kg of cast iron, giving a total of 155.20 kg of cast iron required for the total control arms for car suspension, representing the total control arms for car suspension obtained a metallic yield of 85.98% compared to the total gross molten iron poured (180.5 kg); they were finally subjected to normal cooling for 1 hour and the cast iron control arms for car suspension were removed from the sand mold.

Figure 3A:
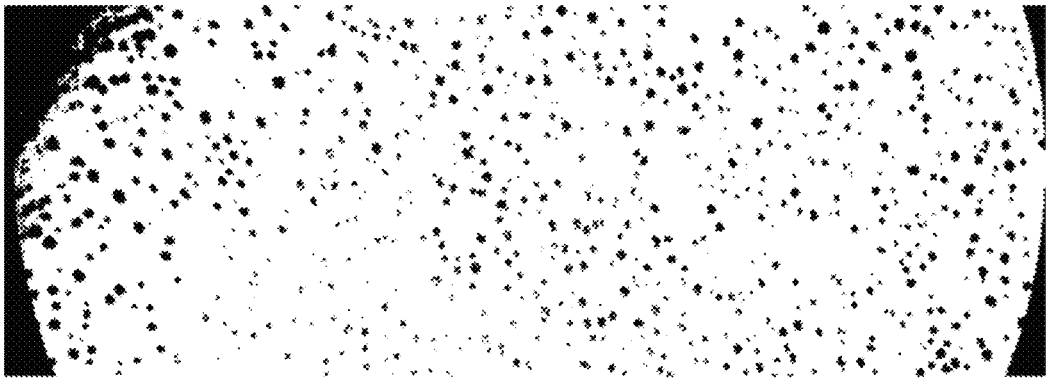
FIG. 3A is a 100× microphotograph of a metallographic sample of a control arm for car suspension in FIG. 2, showing a distribution of crystalline Type I graphites (Lonsdaleite) in accordance with the present invention.
Figure 3B:
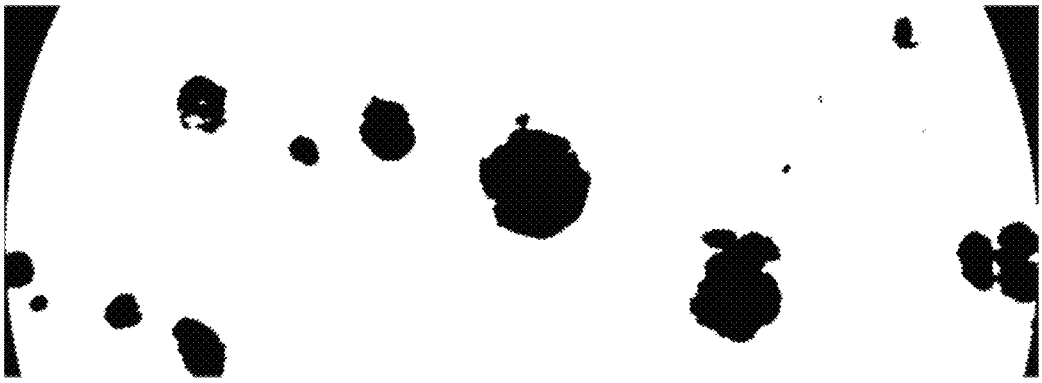
FIG. 3B a 1000× microphotograph of the metallographic sample of a control arm for car suspension in FIG. 2 showing in detail a structure of crystalline Type I graphite (Lonsdaleite) present in accordance with this invention.

A sample of the cast iron items formerly obtained was taken for a metallographic analysis consisting basically of cut, polished and viewed under a microscope, with a 100× increase, crystalline graphite Type I (Lonsdaleite) being observed in 100% with size 6 and a spherical density of 480 spheroids/mm$^2$ (as illustrated in FIG. 3A); whereas at an increase of 1000×, Lonsdaleite consisting of graphite crystalline spheroid (as illustrated in FIG. 3B) is observed.

Preparation of Railway Nodular Iron ASTM D-805506 Grade

Figure 4:
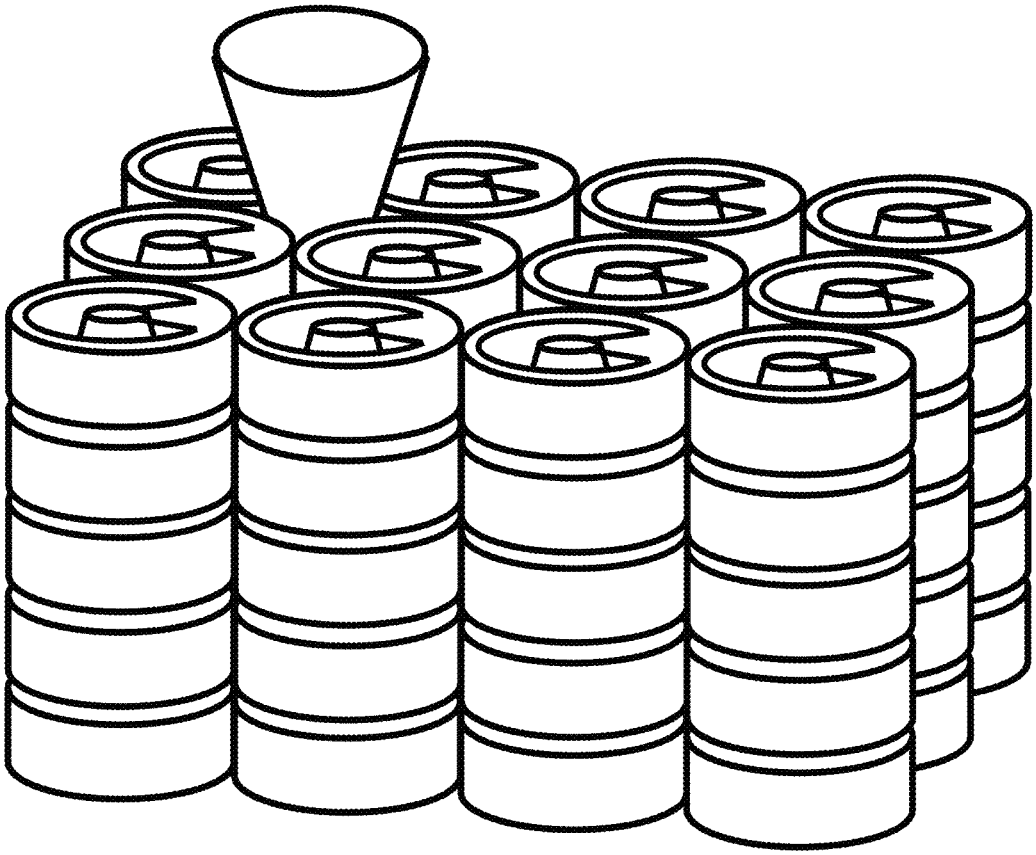
FIG. 4 shows a realization of a tree casting of wheel shaft of railway use molded in a sand mold obtained from the method for producing cast iron items with spheroidal graphite in hexagonal diamond or Lonsdaleite form of the present invention.

A molten iron with 3.85% by weight of carbon was prepared, from a metallic load of 3,500 kg consisting of 40% return, cast iron, 55% steel sheet and 5% pig iron, at a fusion temperature of 1,500° C. The molten iron is reacted at a temperature of 1,450° C. in a reaction pot containing the additive as a spheroidizing agent according to Example 22 of Table 2, in an amount of 35 kg, allowing the formation and precipitation of spheroidal graphites in the molten iron in liquid phase during 56 seconds of reaction; the additive was subsequently inoculated into molten iron as an activator or grain refiner agent according to Example 45 of Table 4 in an amount of 5.25 kg in granular form; then 218.75 kg of molten iron were poured into a sand mold to mold 10 to mold 60 wheel shaft of railway (as shown in FIG. 4), each wheel shaft of railway requiring 3.5 kg of cast iron, giving a total of 210 kg of cast iron required for the total wheels shaft of railway, representing the total wheel shaft of railway obtained a metallic yield of 96% compared to the total gross molten iron poured (218.75 kg); they were finally subjected to normal cooling for 1 hour and the cast iron wheel shaft of railway were removed from the sand mold.

Figure 5A:
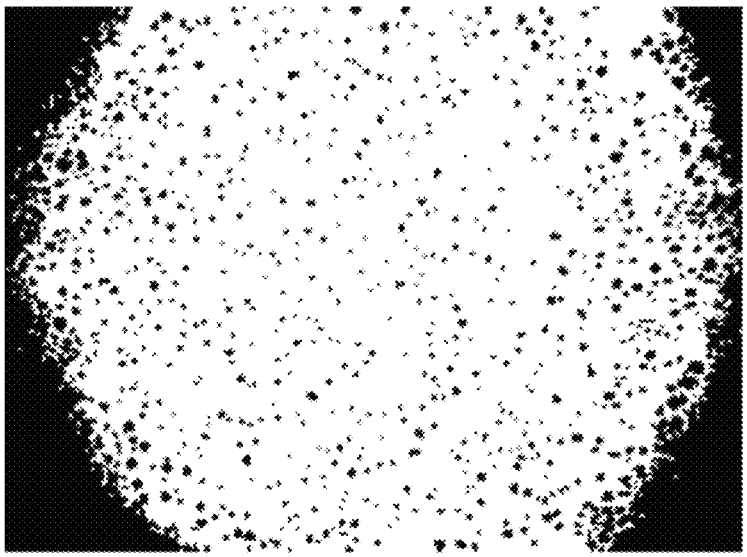
FIG. 5A is a 100× microphotograph of a metallographic sample of a wheel shaft of railway from FIG. 4, showing a distribution of crystalline Type I (Lonsdaleite) graphite according to the present invention.
Figure 5B:
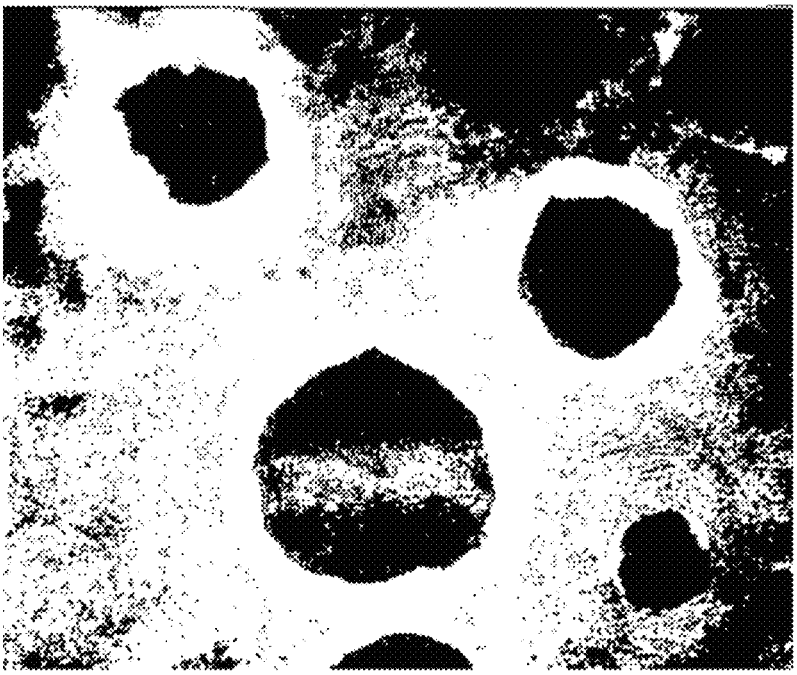
FIG. 5B a 1000× microphotograph of a metallographic sample of a wheel shaft of railway in FIG. 4 showing in detail a structure of crystalline Type I graphite (Lonsdaleite) present in accordance with the invention.

A sample of the cast iron items obtained above was taken for a metallographic analysis consisting basically of cutting, polishing and microscope viewing, observed at a 100× increase. Crystalline graphite Type I (Lonsdaleite) in 100% with size 6 to 7 and a spheroidal density of 520 spheroids/mm$^2$ (as illustrated in FIG. 5A); whereas at an increase of 1000× one can see Lonsdaleite consisting of graphite crystalline spheroid (as illustrated in FIG. 5B).

Based on the achievements described above, it is envisaged that the modifications to these achievements described, as well as the alternative realizations, will be considered evident to an expert person in the art of technique under this description. It is therefore envisaged that the claims cover such alternative realizations that fall within the scope of this invention or its equivalents.

The invention claimed is:

1. A spheroidizing agent for treating molten iron containing carbon to produce cast iron with spheroidal graphite in hexagonal diamond or Lonsdaleite form, the spheroidizing agent comprising:

two or more elements selected from S-block of periods 2 to 7 of the periodic table of elements, wherein each of said S-block elements is present in an amount of 2 to 15% by weight of the total spheroidizing agent; and two or more elements selected from F-block of periods 6 to 7 of the periodic table of elements, wherein each of said F-block elements is present in an amount of 1 to 15% by weight of the total spheroidizing agent;

wherein each of said elements is in metallic state with a purity of at least 85%, and wherein said elements are physically incorporated without forming ionic or covalent bonds in alloys or compounds that includes its mother phase or solvent.

2. The spheroidizing agent according to claim 1 wherein the two or more elements in metallic state selected from S-block of periods 2 to 7 are selected from the group IA of the periodic table of elements.

3. The spheroidizing agent according to claim 2 wherein the two or more elements in metallic state selected from S-block of the group IA of the periodic table of elements are selected from the group consisting of lithium, sodium, potassium, and rubidium.

4. The spheroidizing agent according to claim 1 wherein the two or more elements selected from F-block of periods 6 to 7 are selected from the group consisting of lanthanum, cerium, praseodymium, neodymium, actinium, thorium, and protactinium.

5. The spheroidizing agent according to claim 1 wherein the two or more elements selected from S-block of periods 2 to 7 are selected from the group IIA of the periodic table of elements.

6. The spheroidizing agent according to claim 5 wherein the two or more elements selected from S-block of the group IIA of the periodic table of elements are selected from the group consisting of beryllium, magnesium, calcium, and barium.

7. The spheroidizing agent according to claim 1 wherein further includes one or more elements selected from P-block of group IV A of the periodic table of elements.

8. The spheroidizing agent according to claim 7 wherein the one or more elements selected from P-block of group IV A are selected from the group consisting of carbon and silicon, in an amount of 7 to 70% by weight of the total spheroidizing agent.

9. The spheroidizing agent according to claim 1 wherein further includes elements selected from P-block of group VI A of the periodic table of elements.

10. The spheroidizing agent according to claim 9 wherein the elements selected from P-block of group VI A are selected from the group consisting of oxygen and sulfur, in an amount of 7 to 70% by weight of the total spheroidizing agent.

11. A method for producing the spheroidizing agent of claim 1, the method comprising:

providing two or more elements in metallic state selected from S-block of periods 2 to 7 of the periodic table of elements, and two or more elements in metallic state selected from F-block of periods 6 to 7 of the periodic table of elements; and casting, mixing, and/or joining the two or more elements in metallic state selected from S-block of periods 2 to 7 with the two or more elements in metallic state selected from F-block of periods 6 to 7 of the periodic table of elements, to obtain the spheroidizing agent of claim 1.

12. The method according to claim 11 wherein the two or more elements in metallic state selected from S-block of periods 2 to 7 are selected from the group IA of the periodic table of elements.

13. The method according to claim 12 wherein the two or more elements in metallic state selected from S-block of periods 2 to 7 of the group IA from the periodic table of elements are selected from the group consisting of lithium, sodium, potassium, and rubidium.

14. The method according to claim 11, wherein the two or more elements in metallic state selected from F-block of periods 6 to 7 are selected from the group consisting of lanthanum, cerium, praseodymium, neodymium, actinium, thorium, and protactinium.

15. The method according to claim 11 wherein the two or more elements in metallic state selected from S-block of periods 2 to 7 are selected from the group IIA of the periodic table of elements.

16. The method according to claim 15 wherein the two or more elements in metallic state selected from S-block of group IIA from the periodic table of elements are selected from the group consisting of beryllium, magnesium, calcium, and barium.

17. The method according to claim 11 wherein further includes elements selected from P-block of group IV A of the periodic table of elements.

18. The method according to claim 17 wherein the elements selected from P-block of group IV A are selected from the group consisting of carbon and silicon, in an amount of 7 to 70% by weight of the total spheroidizing agent.

19. The method according to claim 11 wherein further includes elements selected from P-block of group VI A of the periodic table of elements.

20. The method according to claim 19 wherein the elements selected from P-block of group VI A are selected from the group consisting of oxygen and sulfur, in an amount of 7 to 70% by weight of the total spheroidizing agent.

21. The method according to claim 11 wherein the step of casting, mixing, and/or joining the two or more elements in metallic state selected from S-block of periods 2 to 7 with the two or more elements in metallic state selected from F-block of periods 6 to 7 of the periodic table of elements, is achieved in a metallic or metalloid base in casting or solid mixture in solution.

* * * * *